US005590482A

United States Patent [19]

Peterson et al.

[11] Patent Number: 5,590,482

[45] Date of Patent: Jan. 7, 1997

[54] EXCAVATOR AND EARTHEN MATERIAL EXCAVATOR BUCKET APPARATUS

[75] Inventors: Randy S. Peterson, Spokane, Wash.; Thomas W. Steele, Twenty Nine Palms, Calif.; Robert D. Walker, Spokane, Wash.

[73] Assignee: R. A. Hanson Company, Inc., Spokane, Wash.

[21] Appl. No.: 495,340

[22] Filed: Jun. 27, 1995

[51] Int. Cl.[6] ..... E02F 3/04; E02F 3/40

[52] U.S. Cl. ..... 37/403; 37/411; 37/444; 37/903; 414/722; 414/726; 141/108

[58] Field of Search ..... 37/3, 411, 442, 37/443–445, 903, 407, 403; 414/722, 726, 912; 141/108, 109, 250; 220/4.26

[56] References Cited

U.S. PATENT DOCUMENTS

| | | | |
|---|---|---|---|
| 712,095 | 10/1902 | Reed . | |
| 3,195,747 | 7/1965 | Kashergen | 37/444 |
| 3,208,610 | 9/1965 | Logus | 414/726 |
| 3,598,266 | 8/1971 | Fisher | 414/726 |
| 4,009,529 | 3/1977 | Johnson | 172/719 |
| 4,055,255 | 10/1977 | Vasquez | 214/2 |
| 4,068,771 | 1/1978 | Zimmerman | 214/313 |
| 4,782,606 | 11/1988 | Surface | 37/403 |
| 5,004,022 | 4/1991 | Carlsson . | |
| 5,129,169 | 7/1992 | Aubichon . | |
| 5,281,073 | 1/1994 | Gesuale . | |
| 5,493,796 | 2/1996 | Ballew et al. | 414/722 X |

FOREIGN PATENT DOCUMENTS

| | | | |
|---|---|---|---|
| 868446 | 5/1961 | United Kingdom | 37/445 |

*Primary Examiner*—Eric K. Nicholson
*Assistant Examiner*—Thomas A. Beach
*Attorney, Agent, or Firm*—Wells, St. John, Roberts, Gregory & Matkin P.S.

[57] ABSTRACT

An earthen material excavator includes, a) a base undercarriage comprising running gear to move the excavator over the ground; b) a slewing platform; c) a plurality of booms operatively connected to one another, one of the booms being operatively connected with the slewing platform; and d) a digging bucket apparatus mounted to another of the booms, the bucket apparatus including, i) a rigid digging assembly having a fore earth working end and an aft non-earth-working end, the digging assembly comprising an internal throat positioned between the assembly fore and aft ends; and ii) a substantially rigid earthen material container removably mounted relative to the aft end of the rigid digging assembly, the rigid earthen container being mounted in communication with the throat to receive earthen material transferred from the rigid digging assembly through the throat.

17 Claims, 7 Drawing Sheets

EXCAVATOR AND EARTHEN MATERIAL EXCAVATOR BUCKET APPARATUS

TECHNICAL FIELD

This invention relates to earthen material excavators, and to bucket apparatus for earthen material excavators.

BACKGROUND OF THE INVENTION

Typical prior art excavators use a bucket or shovel assembly on the end of an articulating arm which is used to scoop earthen material from horizontal or vertical faces. The bucket assembly is typically provided with sharp teeth to provide digging action against the surface being worked, and further includes a cavity for collecting the material so removed. Once the material is received within the loading bucket, the arm is typically moved to another location for transfer of the material. The bucket is then tipped (or the bottom of the bucket is provided with an openable flap) such that all the material is discharged into a dump truck, conveyor or merely into some other pile.

Dropping of the earthen material in this manner obviously creates a considerable amount of dust. Such is a nuisance as a minimum, and can be outright hazardous depending upon the material being excavated. For example, excavators are finding continuing use at hazardous waste sites, including sites having radioactive material. It would be highly desirable in such situations to enable excavators to be utilized, but at the same time minimize dust generation of the hazardous material.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

In accordance with one aspect of the invention, an earthen material excavator comprises:

- a base undercarriage comprising running gear to move the excavator over the ground;
- a slewing platform;
- a plurality of booms operatively connected to one another, one of the booms being operatively connected with the slewing platform; and
- a digging bucket apparatus mounted to another of the booms, the bucket apparatus comprising:
  - a rigid digging assembly having a fore earth working end and an aft non-earth-working end, the digging assembly comprising an internal throat positioned between the assembly fore and aft ends; and
  - a substantially rigid earthen material container removably mounted relative to the aft end of the rigid digging assembly, the rigid earthen container being mounted in communication with the throat to receive earthen material transferred from the rigid digging assembly through the throat.

The invention also contemplates the above described bucket assembly for an excavator.

Figure 1:
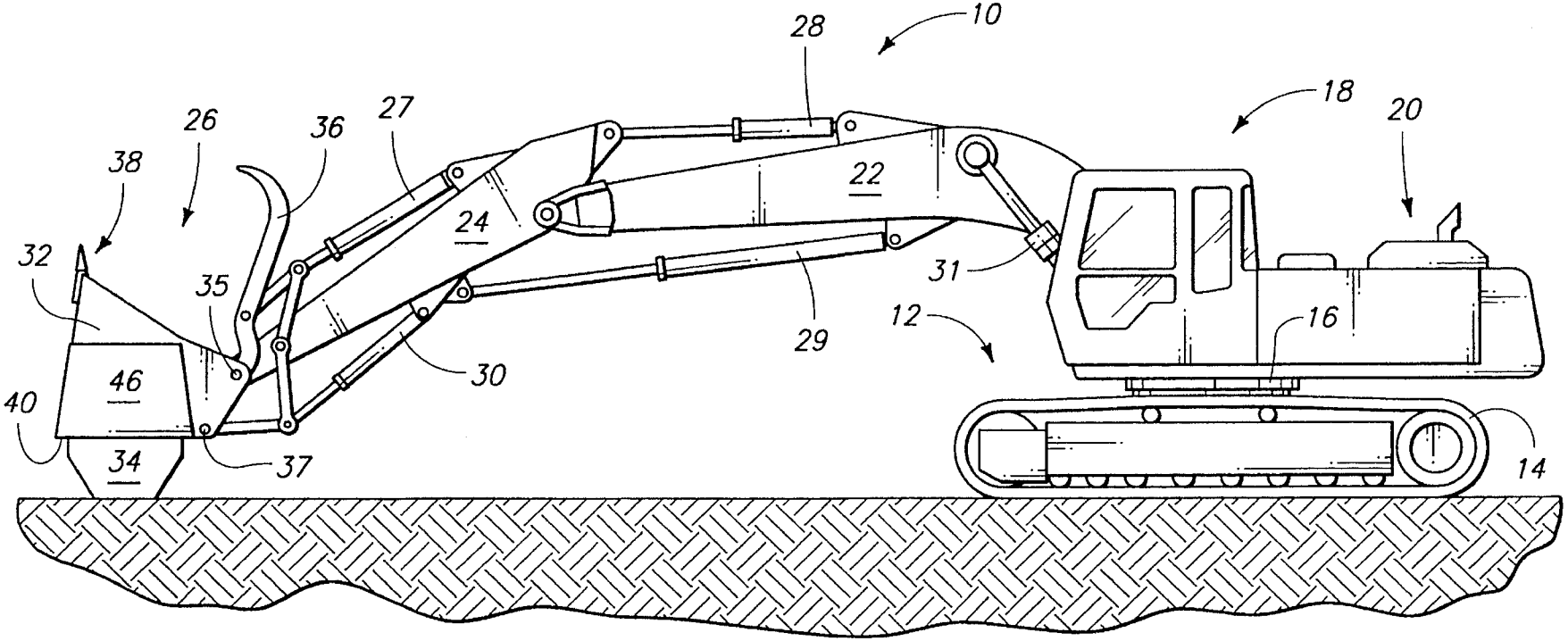
FIG. 1 is a side elevational view of an earthen material excavator in accordance with one aspect of the invention.
Figure 2:
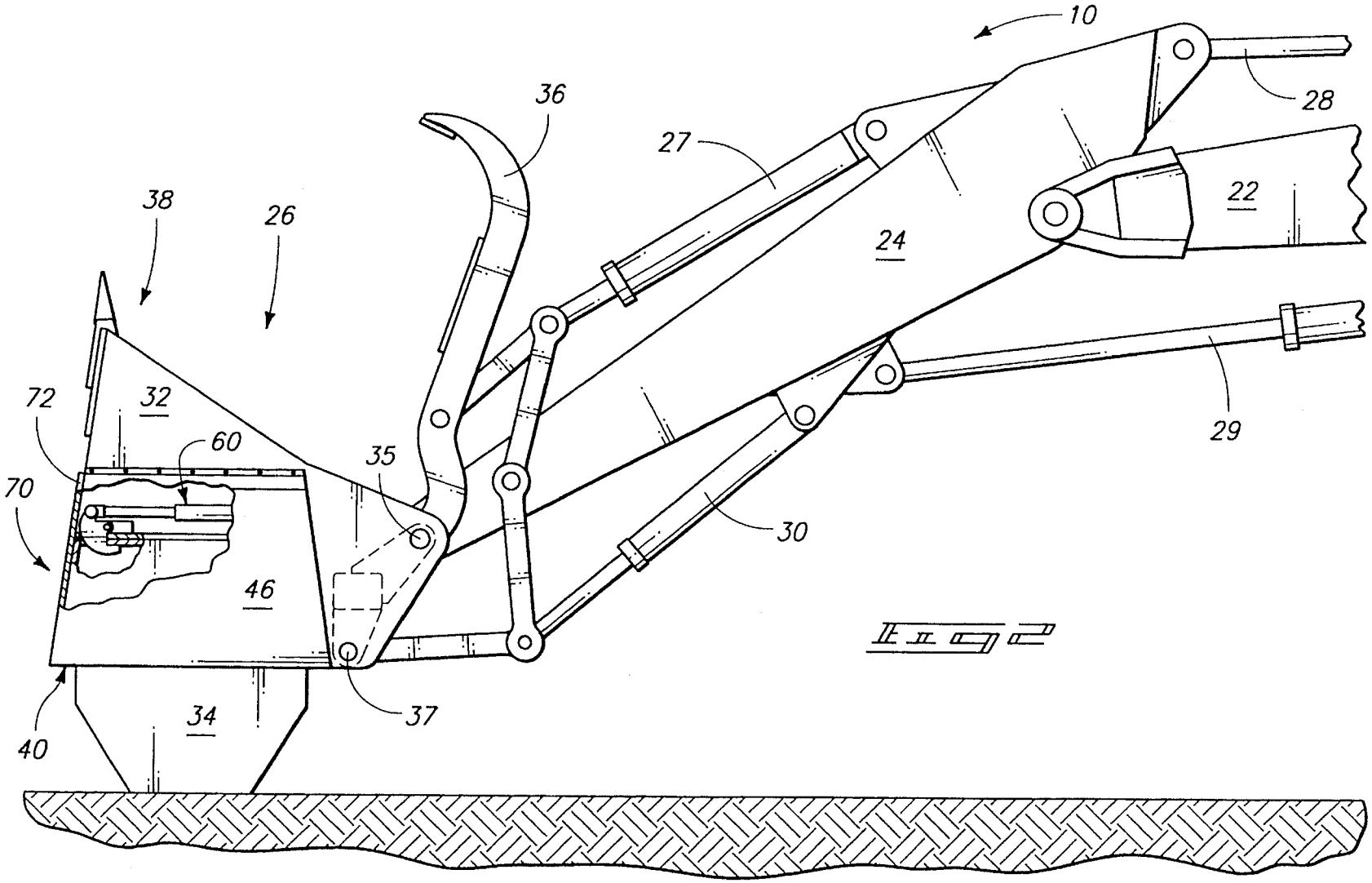
FIG. 2 is an enlarged, partially cut-away, view of the front bucket apparatus portion of the FIG. 1 excavator.
Figure 3:
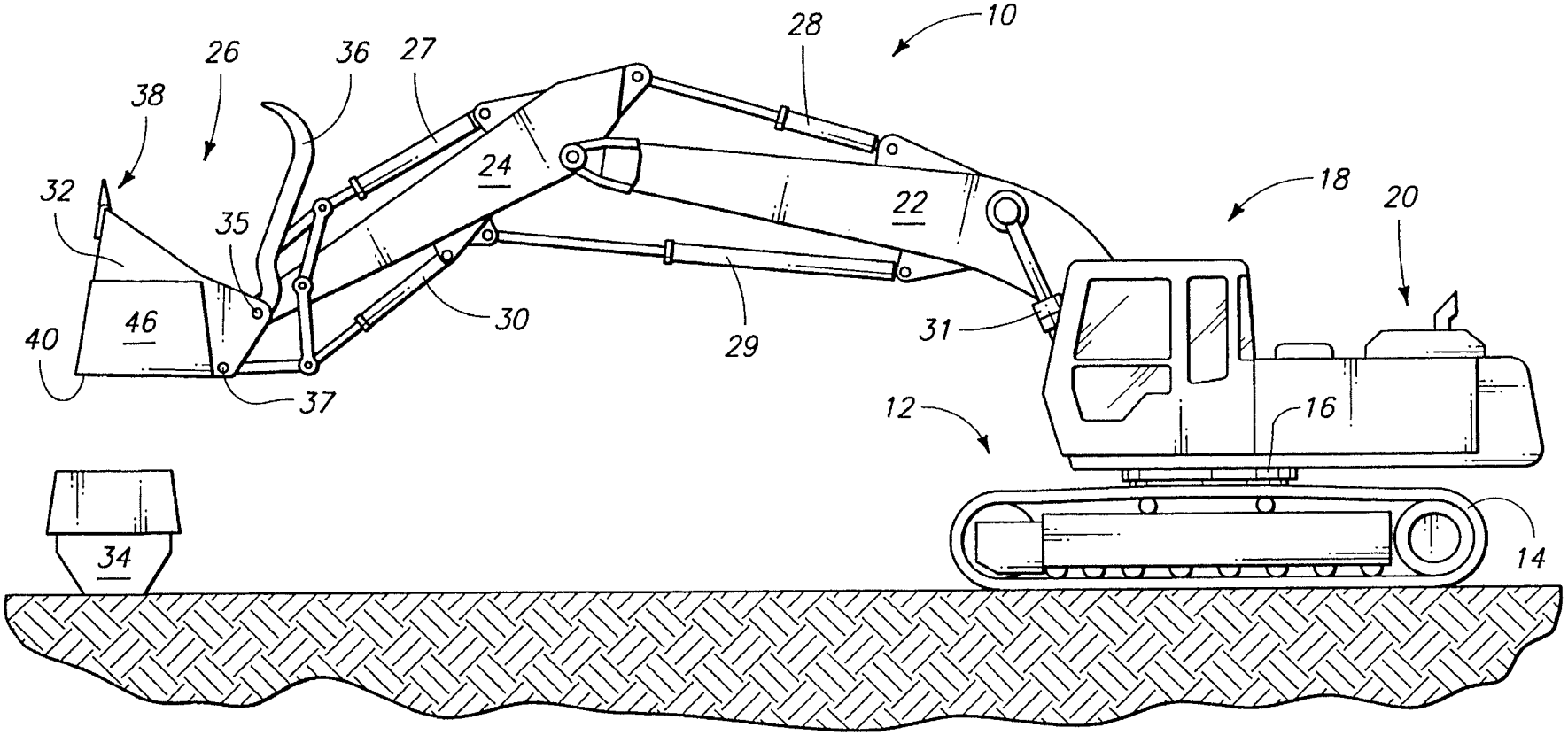
FIG. 3 is a view of the FIG. 1 excavator shown in a different operational condition or position.
Figure 4:
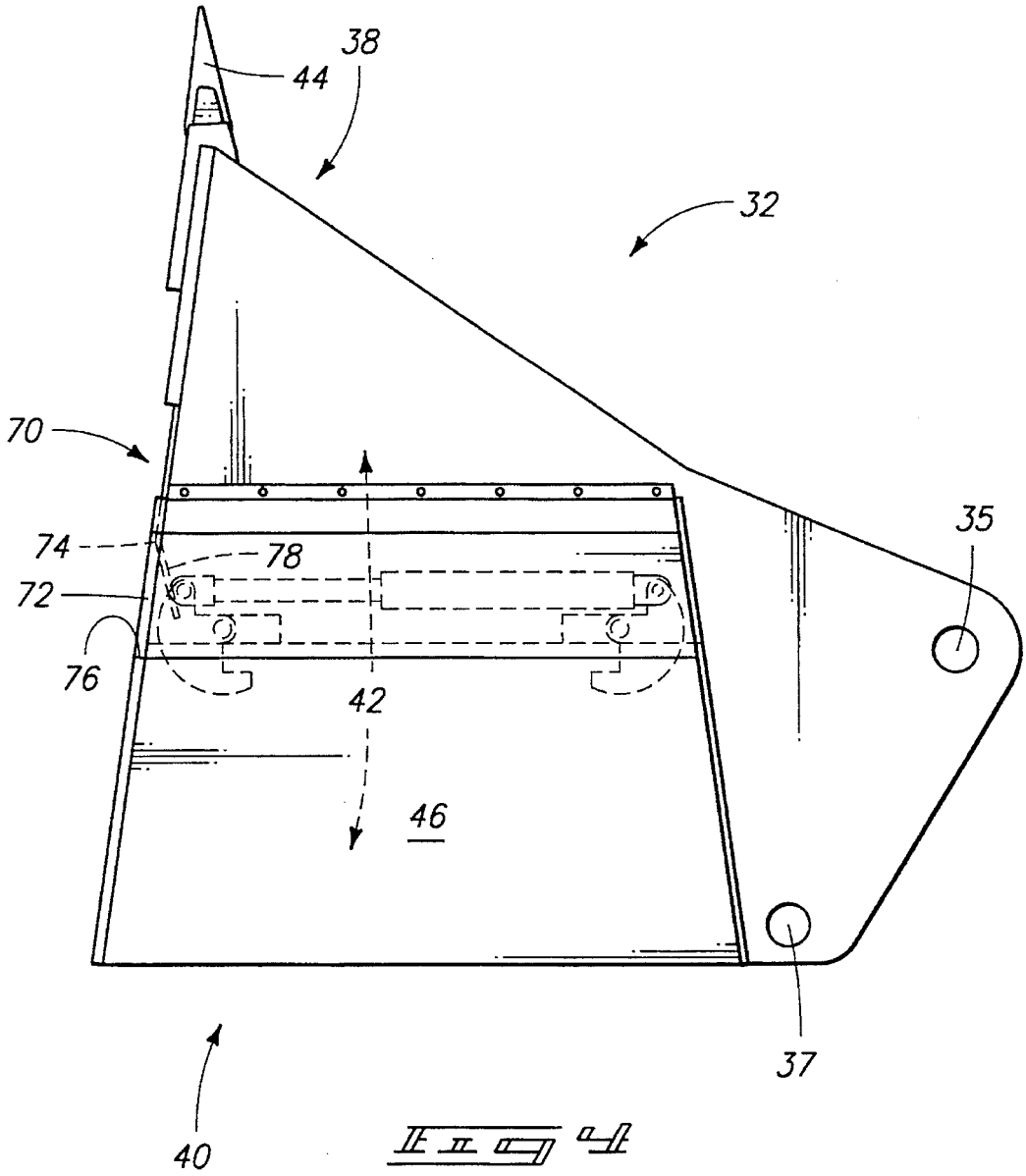
FIG. 4 is an even further enlarged side elevational view of a portion of the FIG. 2 bucket apparatus.
Figure 5:
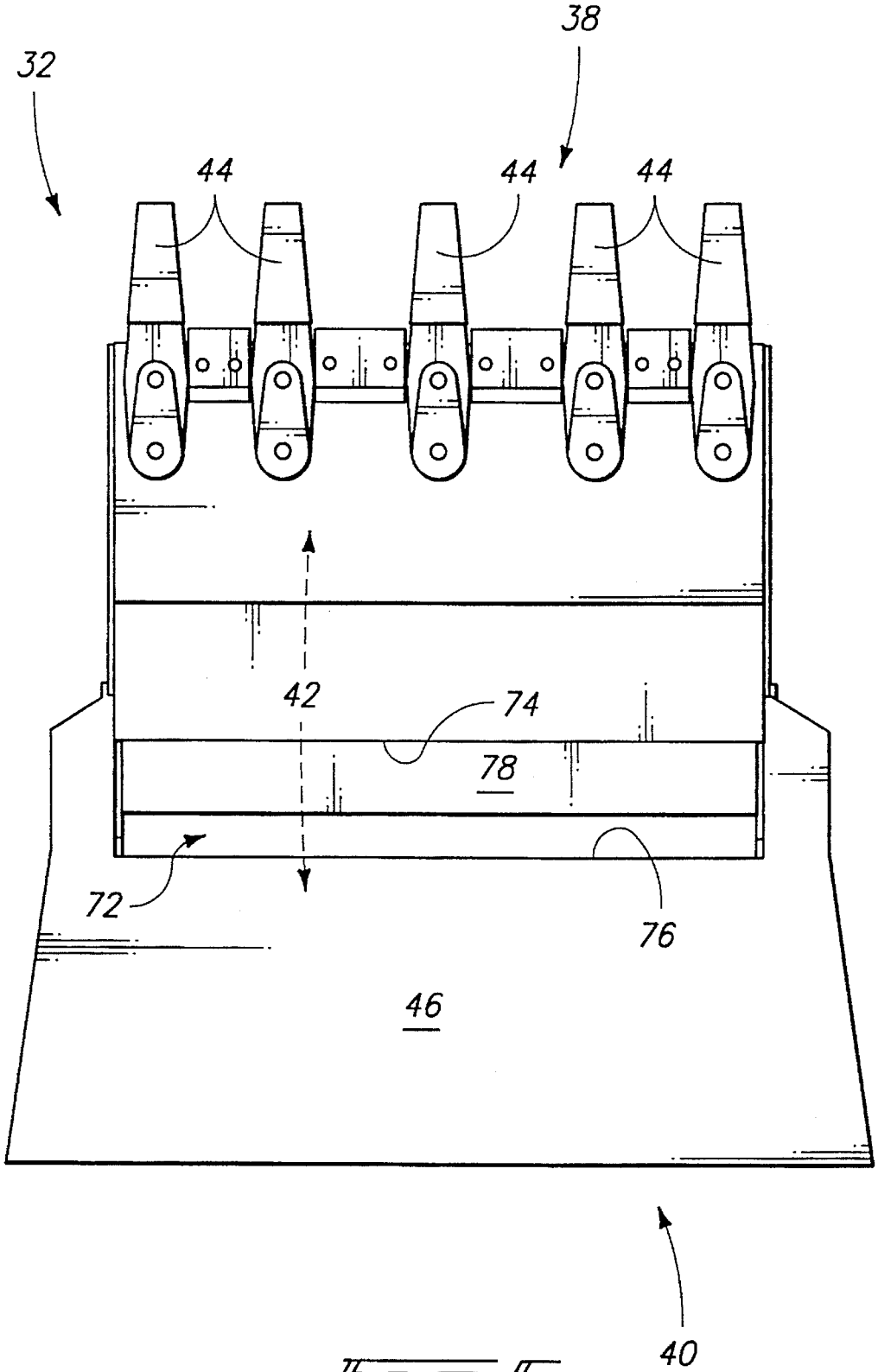
FIG. 5 is a front elevational view of FIG. 4.

More particularly with reference to the figures, an earthen material excavator is indicated generally with reference numeral 10 in FIGS. 1 and 3. Such comprises a base undercarriage 12 having running gear in the form of tracks 14 to move excavator 10 over the ground. A slewing platform 16 is supported relative to base undercarriage 12. An operator cab 18 and internal combustion diesel engine 20 are supported relative to slewing platform 16. A plurality of booms 22 and 24 operably connect relative to one another and relative to slewing platform 16, with boom 24 operative supporting a digging bucket apparatus 26 at its outer fore end. A series of five hydraulic cylinders 27, 28, 29, 30 and 31 are operatively connected as shown for moving boom arms 22 and 24 relative to slewing platform 16, and for operation and positioning of bucket apparatus 26.

More particularly with reference to FIGS. 1–8, earthen material excavator bucket apparatus 26 comprises a rigid digging assembly 32 and a substantially rigid earthen material container 34 removably mounted relative thereto. Digging assembly 32 pivotally connects with fore boom arm 24 about a pivot connection 35. A thumb or lid 36, operable by hydraulic cylinder 27, also connects relative to pivot 35 for grasping objects or closing digging assembly component 32. Hydraulic cylinder 30 connects through lever arms to rigid digging assembly 32 at a pivot location 37 for causing pivoting action of digging assembly 32 about pivot location 35.

For purposes of the continuing discussion, rigid digging assembly 32 comprises a fore earth-working end 38 and an aft non-earth-working end 40. A series of digging teeth 44 is provided at earth-working end 38. An internal throat 42 (FIGS. 4 and 5) lies between assembly fore end 38 and aft end 40. Rigid container 34 is removably mounted relative to aft end 40 of digging assembly 32, with container 34 being mounted in communication with throat 42 to receive earthen material transferred from digging assembly 32 through the throat.

In the illustrated and preferred embodiment, digging assembly 32 and container 34 are cooperatively shaped to removably join with one another in a male-female interconnecting fit. Container 34 comprises a male-like member which is received within throat 42 of digging assembly 32. Digging assembly throat 42 is outwardly tapered aft to define an outwardly tapering receiving skirt 46 at digging assembly aft end 40.

Figure 6:
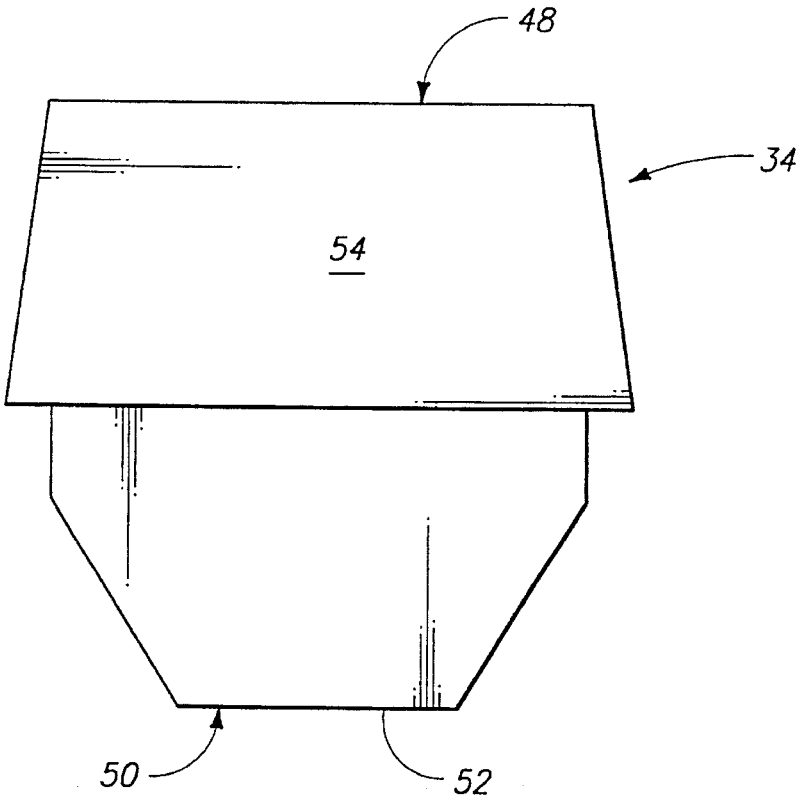
FIG. 6 is a side elevational view of an earthen material container portion of the FIG. 1 apparatus, shown at the same scale as FIG. 4.
Figure 7:
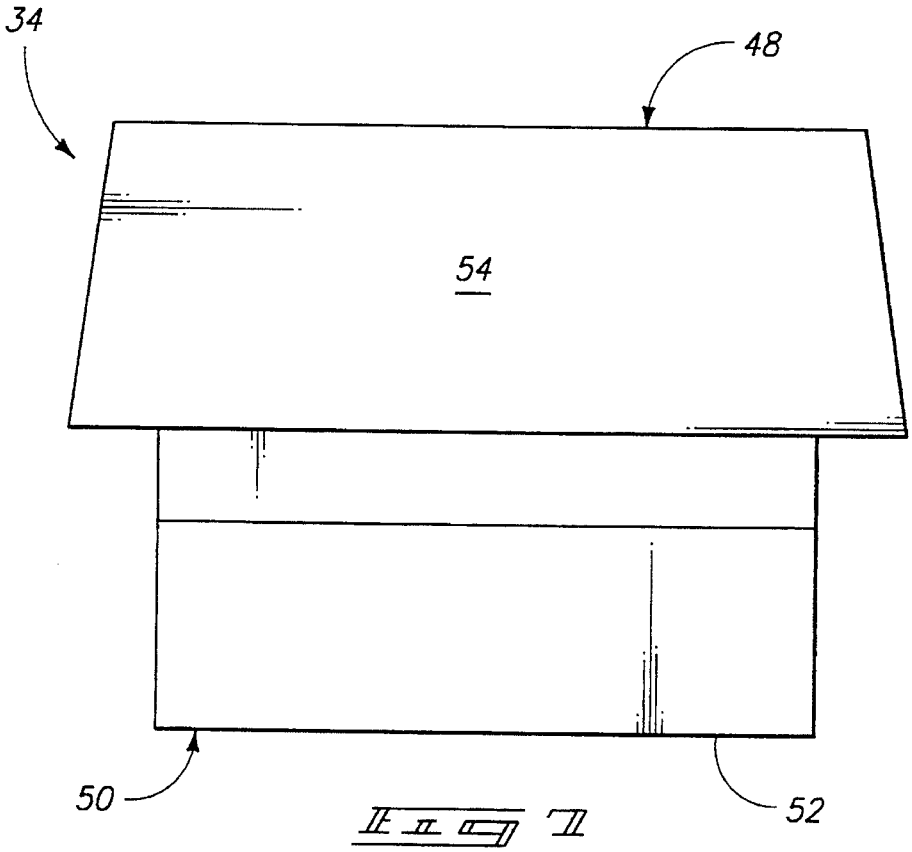
FIG. 7 is a front elevational view of FIG. 6.
Figure 8B:
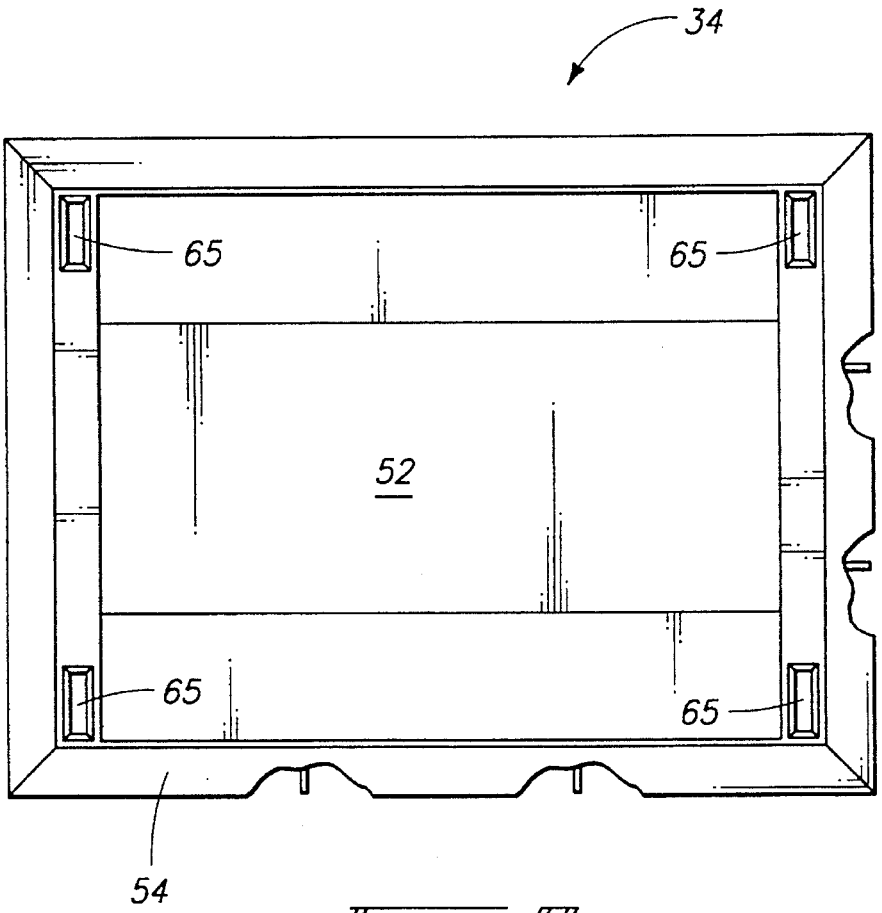
FIG. 8 is a top view of FIG. 7.

Referring more particularly to FIGS. 6–8, container 34 comprises a fore end 48 and an aft end 50. Aft end 50 includes a rigid flat resting surface 52 which is effectively sized to self-support the container in an upright condition relative to the ground when removed from rigid digging assembly 32. The aft end is tapered as shown to facilitate container 34 clearing the ground surface cut by the digging teeth during operation. Container 34 comprises outer sidewall surfaces 54 at its fore end 48 which constitute a correspondingly sized taper for receipt relative to the female taper of skirt 46 of digging assembly 32. Such tapering provides a larger target area for aligning digging assembly 32 with container 34 when joining the two together, and as well provides a self-aligning function of container 34 within throat 42 when the components are joined relative to one another. Moving of digging assembly 32 in a continued downward direction relative to container 34 where there is a degree of misalignment will desirably cause container 34 to slide relative to the ground for perfect aligning receipt within assembly 32.

Figure 9:
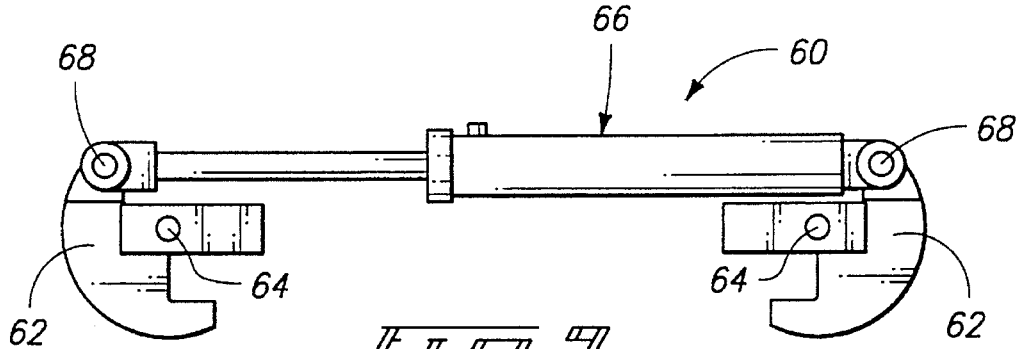
FIG. 9 is a diagrammatical side elevational view of a latch mechanism of the FIG. 1 apparatus shown in one operational position.
Figure 10:
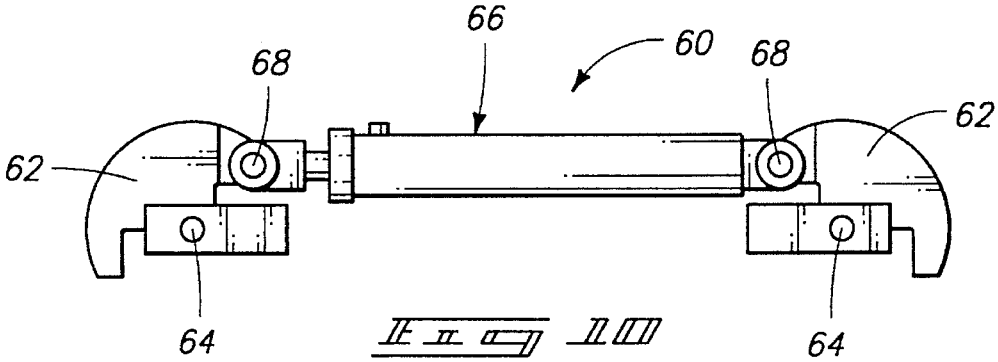
FIG. 10 is a diagrammatical side elevational view of the latch mechanism of the FIG. 1 apparatus shown in another operational position.

Digging assembly 32 and rigid container 34 are removably locked and retained relative to one another by a hydraulic latching assembly 60 (FIGS. 2, 4, 9 and 10) which is mounted relative to digging assembly 32. Latching assembly 60 comprises two respective pairs of latch ear members 62 which pivotally mount relative to digging assembly 32 about respect pivot locations 64. Container 34 includes corresponding pairs of latch openings 65 (FIG. 8) which are sized to receive members 62. A floating hydraulic cylinder assembly 66 interconnects between and pivotally connects to each of latches 62 at respective pivot locations 68 for movement of the latches for locking the container and digging assembly relative to one another. FIGS. 9 and 10 in more detail show the positioning of assembly 60, with FIG. 9 indicating the locked or latched position, and FIG. 10 indicating the unlatched position. Cylinder assembly 66 is preferably connected as shown to be mounted only at pivot locations 68 for lateral floating movement between and relative to latch ear pivot locations 64.

For purposes of the continuing discussion, digging assembly 32 can be considered as having an outer base face 70. Such is provided with an overflow slot 72 extending therethrough to internal throat 42. Overflow slot 72 is positioned to be adjacent container fore end 48 when container 34 is fully received by digging assembly 32. Slot 72 accommodates overflow of earthen material from container 34 outwardly of digging assembly 32 and bucket apparatus 24. Overflow slot 72 has a fore edge 74 and an aft edge 76. A diversion flap 78 of digging assembly 32 angles into throat 42 from base face 70 in an aft direction from adjacent slot fore edge 74. Such facilitates diversion of earthen material at the point of removal from a face of such material from undesirably initially falling through slot 72 as opposed to filling container 34.

In operation, bucket apparatus 26 would be utilized to remove or otherwise dig material from a horizontal or vertical face being worked. Thumb or jaw 36 could be utilized for prying or pulling large objects, such as stumps or metal or other components, from such face. Material removed would flow essentially through throat 42 and collect within container 34. Diversion flap 78 facilitates flow of such material into container 34 as opposed to outwardly of slot 72 and outer base face 70. Yet if material overfills container 34 within assembly 26, such can overflow from container 34 outwardly through slot 72. Accordingly and most preferably, container 34 is thusly provided to be substantially full of material, but not overfull, when held in a position such as shown in FIG. 1.

Once full, the articulating arms of the excavating apparatus would be pivoted by the slewing platform to position container 34 in a desired location. Such might be for example on the ground as shown in FIG. 1, or more typically and preferably on the flatbed on the back of a truck or rail car. Upon such placement in resting self-support relative to container surface 52, latch mechanism 60 would be activated to release container 34, and the boom arms operated to raise digging assembly 32 therefrom (FIG. 3). The boom arms would then be operated to retrieve another empty, waiting container 34 for further removal and collection of material. Thusly, dust generation beyond the site of removal is minimized by preventing material removed by a bucket assembly of a front loading excavator from being discharged by dropping into a pile of such material.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. An earthen material excavator bucket apparatus comprising:

a rigid digging assembly having a fore earth working end, and an aft non-earth-working end, the digging assembly further comprising an internal, substantially enclosed throat positioned between the digging assembly fore and aft ends; and a substantially rigid earthen material container releasably mounted relative to the non-earth-working end of the rigid digging assembly, the rigid earthen material container having a fore end which is removably received relative to the non-earth-working end of the rigid digging assembly, the fore end defining an opening which matingly cooperates with the throat, and an aft end which is effective to self-support the earthen material container in an upright condition when removed from the rigid digging assembly, and wherein the opening defined by the fore end of the rigid earthen material container faces generally upwardly away from the face of the earth when the container is released from the rigid digging assembly and positioned in self supporting relation on the face of the earth.

2. An earthen material excavator bucket as claimed in claim 1, and further comprising a latching assembly to removably lock and retain the earthen material container relative to the rigid digging assembly.

3. An earthen material excavator bucket as claimed in claim 1, and further comprising a latching assembly borne by the rigid digging assembly to removably lock and retain the earthen material container relative to the rigid digging assembly, and wherein the earthen material container comprises at least one pair of latch openings, and wherein the latching assembly matingly cooperates with the at least one pair of latch openings.

4. An earthen material excavator bucket as claimed in claim 3, wherein the latching assembly comprises at least one pair of pivotally mounted latches which are operable to be received within the container latch opening to lock the earthen material container and rigid digging assembly together, and wherein a floating hydraulic cylinder is mounted in force transmitting relation relative to each of the respective latches.

5. An earthen material excavator bucket as claimed in claim 1, wherein the rigid digging assembly further comprises an outer face having an overflow slot provided therethrough to the substantially enclosed internal throat, the overflow throat positioned adjacent the earthen material container fore end when the earthen material container is fully received by the rigid digging assembly for accommodating overflow of material from the earthen material container outwardly of the rigid digging assembly.

6. An earthen material excavator bucket apparatus comprising:

a rigid digging assembly having a fore earth working end and an aft non-earth working end, the digging assembly comprising an internal throat positioned between the digging assembly fore and aft ends; and a substantially rigid earthen material container removably mounted relative to the aft end of the rigid digging assembly, the rigid earthen material container being mounted in communication with the throat to receive earthen material transferred from the rigid digging assembly through the throat, and wherein the container comprises a fore end an aft end, the container fore end being removably received relative to the digging assembly, and wherein the digging assembly further includes an outer base face having an overflow slot provided therethrough to the internal throat, the overflow slot being positioned to be adjacent the container fore end when the container is fully received by the digging assembly for accommodating overflow of earthen material from the container outwardly of the digging assembly and the apparatus.

7. The earthen material excavator bucket apparatus of claim 6 wherein the overflow slot has a fore edge and an aft edge, the digging assembly further comprising a diversion flap angling into the throat in an aft direction from adjacent the slot fore edge.

8. An earthen material excavator bucket apparatus comprising:

a rigid digging assembly having a fore earth working end, and an aft non-earth-working end, the digging assembly comprising an internal, substantially enclosed throat positioned between the digging assembly fore and aft ends;

a substantially rigid earthen material container removably mounted relative to the aft end of the rigid digging assembly, the rigid earthen container being mounted in communication with the throat to receive earthen material transferred from the rigid digging assembly through the throat; and a latching assembly, borne by the digging assembly to removably lock and retain the earthen material container relative to the digging assembly.

9. The earthen material excavator bucket apparatus of claim 8 wherein the container comprises at least one pair of latch openings, and wherein the rigid digging assembly comprises a hydraulic latching assembly to removably lock and retain the container relative to the digging assembly, the hydraulic latching assembly comprising:

at least one pair of latches pivotally mounted relative to the digging assembly, the latches being sized to be received within the container latch openings to lock the container and digging assembly relative to one another; and a floating hydraulic cylinder assembly interconnecting between and pivotally connected to each of the latches of the pair.

10. An earthen material excavator bucket apparatus having a fore earth working end, and an aft non-working end, the digging assembly comprising an internal throat positioned between the digging assembly fore and aft ends; and a substantially rigid material container removably mounted relative to the aft end of the rigid digging assembly, the rigid earthen material container being mounted in communication with the throat to receive earthen material transferred from the rigid digging assembly through the throat, and wherein the earthen material container further comprises a fore end, and an aft end, the fore end being removably received relative to the digging assembly, and the aft end including a rigid flat resting surface effectively sized to self-support the earthen material container in an up-right condition when removed from the rigid digging assembly, and wherein the digging assembly further includes an outer base face having an overflow slot provided therethrough to the internal throat, the overflow slot positioned adjacent the earthen material container fore end when the earthen material container is fully received by the digging assembly for accommodating overflow of earthen material from the earthen material container outwardly of the digging assembly and the apparatus.

11. An earthen material excavator bucket apparatus comprising:

a rigid digging assembly having a fore earth working end, and an aft non-earthworking end, the digging assembly comprising an internal throat positioned between the rigid digging assembly fore and aft ends;

a substantially rigid earthen material container removably mounted relative to the aft end of the rigid digging assembly, the rigid earthen material container being mounted in communication with the throat to receive earthen material transferred from the rigid digging assembly through the throat, and wherein the earthen material container further comprises a fore end and an aft end, the fore end being removably received relative to the digging assembly and the aft end including a rigid flat resting surface effectively sized to self-support the earthen material container in an upright condition when removed from the rigid digging assembly; and a latching assembly borne by the digging assembly to removably lock and retain the earthen material container relative to the digging assembly.

12. An earthen material excavator comprising:

a base undercarriage comprising a running gear to move the excavator over the ground;

a slewing platform supported relative to the base undercarriage;

a plurality of booms operatively connected to one another, one of the booms being operatively connected with the slewing platform;

a digging bucket apparatus mounted on another of the booms, the bucket apparatus comprising:

a rigid digging assembly having a fore earth working end, and an aft non-earth-working end, the digging assembly having an internal throat positioned between the rigid digging assembly fore and aft ends; and a substantially rigid earthen material container removably mounted relative to the aft end of the rigid digging assembly, the rigid earthen material container being mounted in communication with the throat to receive earthen material transferred from the rigid digging assembly through the throat, and wherein the earthen material container further comprises a fore end and an aft end, the container fore end being removably received relative to the digging assembly, and wherein the digging assembly further includes an outer base face having an overflow slot provided therethrough to the internal throat, the overflow slot positioned adjacent the container fore end when the container is fully received by the digging assembly for accommodating overflow of earthen material from the container outwardly of the digging assembly and the apparatus.

13. The earthen material excavator of claim 12 wherein the overflow slot has a fore edge and an aft edge, the digging assembly further comprising a diversion flap angling into the throat in an aft direction from adjacent the slot fore edge.

14. The earthen material excavator of claim 12 wherein the rigid digging assembly comprises a hydraulic latching assembly to removably lock and retain the container relative to the digging assembly.

15. The earthen material excavator of claim 12 wherein the container comprises at least one pair of latch openings, and wherein the rigid digging assembly comprises a hydraulic latching assembly to removably lock and retain the container relative to the digging assembly, the hydraulic latching assembly comprising:

at least one pair of latches pivotally mounted relative to the digging assembly, the latches being sized to be received within the container latch openings to lock the container and digging assembly relative to one another; and a floating hydraulic cylinder assembly interconnecting between and pivotally connected to each of the latches of the pair.

16. The earthen material excavator of claim 12 wherein, the aft end includes a rigid flat resting surface effectively sized to self-support the container in an upright condition when removed from the rigid digging assembly.

17. The earthen material excavator of claim 12 wherein, the aft end includes a rigid flat resting surface effectively sized to self-support the container in an upright condition when removed from the rigid digging assembly; and a latching assembly is borne by the rigid digging assembly to removably lock and retain the earthen material container relative to the digging assembly.

* * * * *